United States Patent [19]

Cantu

[11] Patent Number: 4,560,361

[45] Date of Patent: Dec. 24, 1985

[54] WHEELED TOY WITH WHEEL-DRIVEN DECORATIVE MEANS

[76] Inventor: Paul Cantu, 4012 Tod Ave., E. Chicago, Ind. 46312

[21] Appl. No.: 603,249

[22] Filed: Apr. 23, 1984

[51] Int. Cl.[4] ..... A63H 17/26

[52] U.S. Cl. ..... 446/231; 446/237; 446/448

[58] Field of Search ..... 446/236, 237, 238, 246, 446/272, 274, 277, 278, 280, 281, 282, 288, 292, 293, 294, 352, 448, 449

[56] References Cited

U.S. PATENT DOCUMENTS

| | | | |
|---|---|---|---|
| 1,371,834 | 3/1921 | Adamski | 446/237 |
| 1,527,205 | 2/1925 | McPherson | 446/237 |
| 1,643,917 | 9/1927 | Becker | 446/237 |
| 2,024,135 | 12/1935 | Baker | 446/352 |
| 2,775,846 | 1/1957 | Gazda | 446/292 |
| 4,129,962 | 12/1978 | Goldner | 446/246 |

FOREIGN PATENT DOCUMENTS

| | | | |
|---|---|---|---|
| 8224 | 10/1956 | Fed. Rep. of Germany | 446/280 |

*Primary Examiner*—F. Barry Shay

*Attorney, Agent, or Firm*—Laurence R. Brown

[57] ABSTRACT

Decorative objects such as spheres are rotated on a toy vehicle at body locations remote from a rotating wheel, which serves as the drive mechanism therefor. Thus a flexible cable, such as formed from coiled spring wire, is journalled about a body path by eyelets to rotate the objects when affixed to the cable at one or more locations. One embodiment, substantially of streamlined rocket shape, with a plurality of rotatable spheres spaced about a generally cylindrical body and shrouded with decorative cover panels overlying the eyelets thus gives the effect of a space object such as a comet when propelled by a suitable motor across a floor surface, for example.

3 Claims, 3 Drawing Figures

WHEELED TOY WITH WHEEL-DRIVEN DECORATIVE MEANS

FIELD OF THE INVENTION

This invention relates to wheeled vehicular toys, and more particularly it relates to toys having movable decorative displays driven by wheels.

BACKGROUND ART

Toys having wheel driven decorative displays are typified by U.S. Pat. No. 1,643,917 issued Sept. 27, 1927 to J. J. Becker. This art however is most complex, requiring various gears and linkages for transmission of the motive power from the wheels. Furthermore, such linkages cannot be optionally added as a feature to existing toys, or added to many types of toys, because the mechanisms themselves are not decorative or readily concealable and need be hidden internally out of view, or need much more room than generally available.

It is therefore an objective of this invention to improve the state of the prior art, and to correct the foregoing deficiencies.

Other objects features and advantages of the invention will be found throughout the following description, drawings and claims.

DISCLOSURE OF THE INVENTION

In accordance with this invention rotatable decorative objects are attached along the length of a flexible cable rotated by a connection to a wheel or axle of a wheeled toy vehicle so that they may be placed at various external body locations. The cable is journalled in eyelets affixed to the body, which serve to support the decorative objects, to locate them and to journal the rotatable cable. The cable in a preferred embodiment comprises a coiled spring wire, that of itself may serve as a part of the decorative assembly, which can move in fanciful motion paths when rotating with an object attached therto.

BRIEF DESCRIPTION OF THE DRAWINGS

Preferred embodiments of the invention are set forth in the accompanying drawings and are described with particularity in the following description, wherein the similar reference characters in the several views reference similar features. In the drawing.

THE PREFERRED EMBODIMENT

Figure 1:
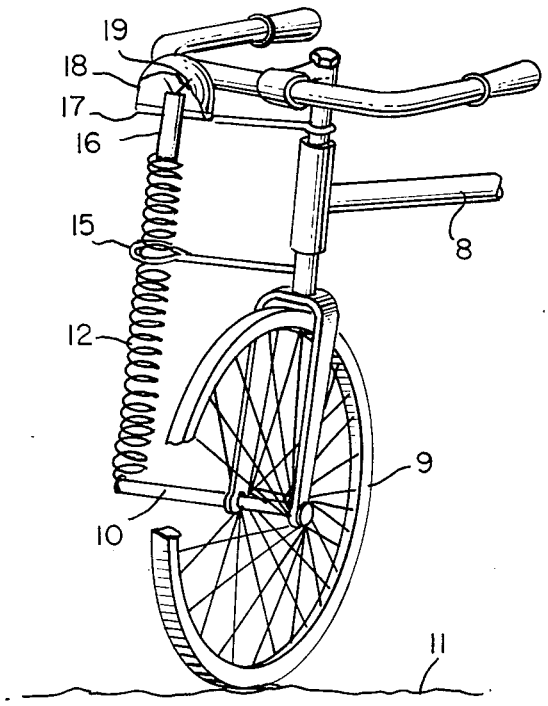
FIG. 1 is a partially cut away perspective view of a toy police motorcycle constructed in accordance with the teachings of this invention.

The operational principle of the invention may be understood by reference to FIG. 1, where the front end of a toy motor police cycle 8 is shown. In the cut away portion of front wheel 9, it is seen that the wheel axle 10 or member, that turns with the wheel as it rolls on the surface 11, is coupled to rotate the flexible coil srping cable 12. The cable 12 passes through and is effectively journalled for rotation in the eyelet 15 attached to the vehicle frame. Thus the cable 12 may rotate a decorative (or functional) member such as the rotary reflector 19 within the blue or red transparent dome 18 usually provided on a police vehicle. This dome 18 is mounted on bracket 17 to the vehicle frame with extending rotatable shaft 16 journalled therin and coupled to the cable 12 for rotation therewith.

Thus it is seen that a flexible cable 12 is coupled to rotate any suitable decorative or functional rotatable means positioned at a remote location from the wheel which rotates the cable as the vehicle moves. Guide means 15 intermediate the wheel and rotatable means serves to journal the cable and in some embodiments to support the remote rotatable means.

Figure 2:
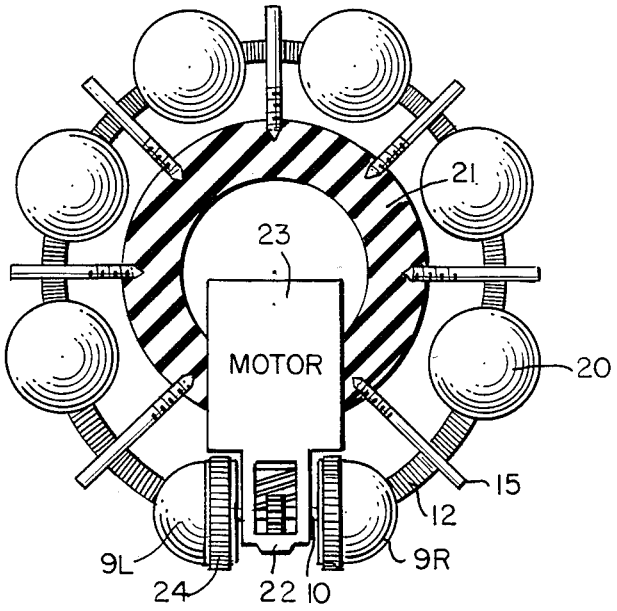
FIG. 2 is an end view, partly in section, of a wheeled vehicular toy embodiment of the invention.

FIG. 2 illustrates the latter function of supporting the weight of the decorative spherical rotating means 20 by the eyelet guides 15 arranged between the spheres. In this embodiment, the vehicle body 21 is substantially cylindrical in shape so that the set of spaced decorative spheres 20 ring the body to rotate as the vehicle moves. If desired the spheres may contain a design that accentuates the rotation effect. Note that the coil spring cable assembly 12 may permit the balls to bounce or otherwise move as the cable is rotated, for a decorative effect as desired in the embodiment later described to simulate a meteor or comet effect.

The wheels 9L and 9R in this embodiment are driven by drive axle 10 by way of gear box 22 and electric motor 23 in a conventional manner by the usual battery and switch. Coiled spring tires 24 may be added for increased frictional contact with the surface on which the vehicle is driven.

Figure 3:
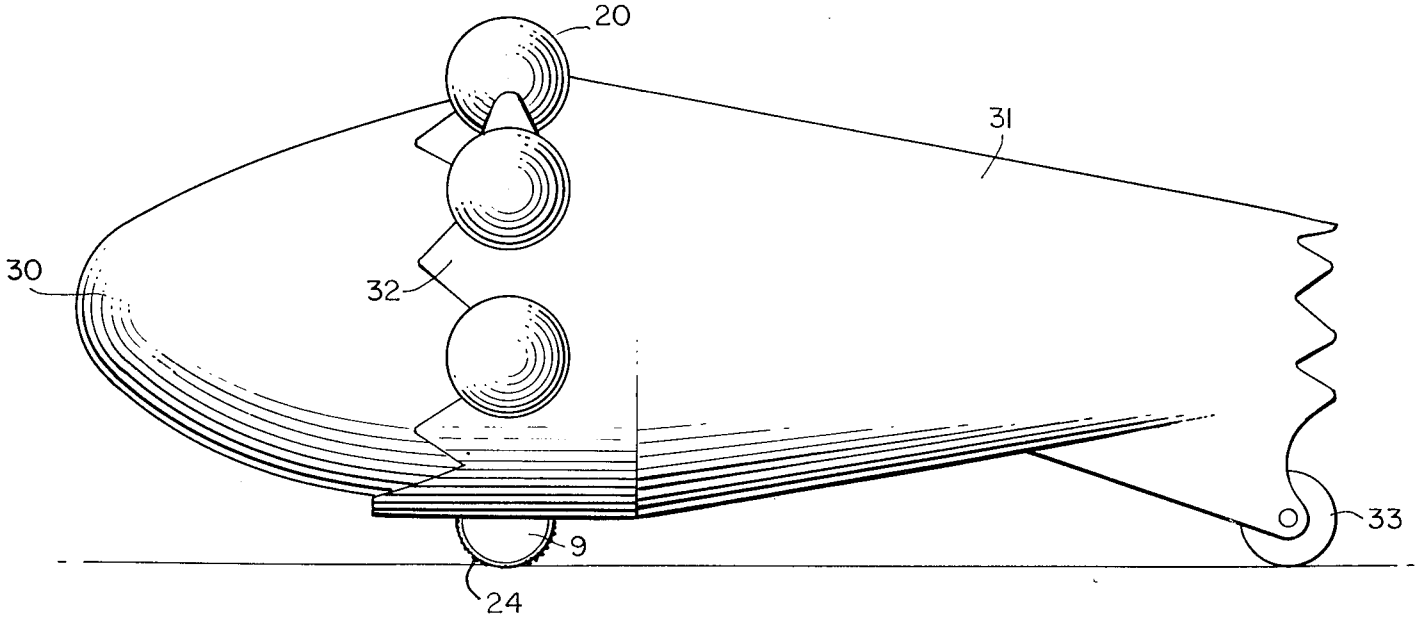
FIG. 3 is a side profile view of a wheeled vehicular toy embodiment of the invention simulating a space object such as a comet or meteor.

As shown in FIG. 3, the vehicle body may have decorative shrouds or covers that cover parts of the eyelets and cable, if desired. Thus an egg shaped nose piece 30 and a tail section 31 converging therefrom may have overlapping tabs 32 that cover the eyelets and cable and show basically only the rotating spheres to simulate a space object such as a comet or meteor. For purpose of moving on a surface such as a floor or table the tail wheel 33 is provided.

Therefore having advanced the state of the art, those features of novelty believed descriptive of the nature and spirit of the invention are defined with particularity in the claims.

I claim:

1. A wheeled vehicular toy with a generally cylindrically shaped vehicle body and a plurality of rotatable wheels propellable across a surface contacted by at least one of said rotatable wheels to drive the vehicle, comprising in combination, a shaft coupled to and rotatable with two of said rotatable vehicles, drive wheels contacting the surface, a flexible cable having it's ends coupled to two opposite ends of the shaft for rotation therewith, rotatable means comprising a set of spaced decorative spheres coupled with said cable at different positions therealong to rotate therewith thereby to ring said cylindrical body with said set of spheres that rotate as the vehicle moves, and guide means coupled to the body of the vehicle for journalling the cable for rotation, said guide means being located between adjacent ones of said spheres and between said spheres and said wheels, whereby rotation of the wheel as the vehicle moves causes the spheres to rotate by means of the interposed cable.

2. A toy as defined in claim 1 wherein said body is covered with decorative structure cooperating with the rotating spheres to simulate a space object.

3. A toy as defined in claim 2 wherein the wheels are motor driven.

* * * * *